US007771375B2

(12) United States Patent
Nishibori et al.

(10) Patent No.: US 7,771,375 B2
(45) Date of Patent: Aug. 10, 2010

(54) CUSHION AND ACOUSTIC SYSTEM WITH THE CUSHION

(75) Inventors: Sadao Nishibori, Gifu (JP); Iwao Kouno, Gifu (JP); Yuichiro Nakamura, Gifu (JP)

(73) Assignee: EIN Co. Ltd. Technical Center, Gifu (JP)

( * ) Notice: Subject to any disclaimer, the term of this patent is extended or adjusted under 35 U.S.C. 154(b) by 1117 days.

(21) Appl. No.: 10/573,423

(22) PCT Filed: Sep. 27, 2004

(86) PCT No.: PCT/JP2004/014096

§ 371 (c)(1),
(2), (4) Date: Mar. 23, 2006

(87) PCT Pub. No.: WO2005/030011

PCT Pub. Date: Apr. 7, 2005

(65) Prior Publication Data

US 2007/0086612 A1 Apr. 19, 2007

(30) Foreign Application Priority Data

Sep. 29, 2003 (JP) ..... 2003-338138

(51) Int. Cl.
*A61H 23/00* (2006.01)
*A47C 17/86* (2006.01)

(52) U.S. Cl. ..... 601/47; 601/57; 5/904; 5/915; 5/933; 5/952

(58) Field of Classification Search ..... 601/46, 601/47, 49, 56–60; 5/904, 915, 933, 952
See application file for complete search history.

(56) References Cited

U.S. PATENT DOCUMENTS

| | | | | | |
|---|---|---|---|---|---|
| 2,980,108 | A | * | 4/1961 | Scott | 601/57 |
| 3,893,731 | A | * | 7/1975 | Maggs | 297/452.17 |
| 4,782,533 | A | * | 11/1988 | Haynie | 381/301 |
| 4,862,438 | A | * | 8/1989 | Fry | 369/19 |
| 5,063,912 | A | * | 11/1991 | Hughes | 601/47 |
| 5,216,769 | A | * | 6/1993 | Eakin | 5/620 |
| 5,819,346 | A | * | 10/1998 | Lane | 5/639 |

(Continued)

FOREIGN PATENT DOCUMENTS

JP 61-220653 9/1986

(Continued)

*Primary Examiner*—Danton DeMille
(74) *Attorney, Agent, or Firm*—Porzio Bromberg & Newman, P.C.

(57) ABSTRACT

A cushion comprises a resin body with a spring structure having permeability comprising a three-dimensional structure including voids at a predetermined bulk density, the three-dimensional structure being obtained by contacting, entwining, and gathering adjacent ones of random loops or curls of continuous filaments made from a thermoplastic resin in such a manner as to allow the resulting structure to have a layered structure in which layers composed of filaments having a high bulk density as superficial layers are formed on a front and a rear of the resin body in a lengthwise direction, and a layer composed of the filaments having a low bulk density as a core layer is interposed between the superficial layers; and a speaker incorporated in the resin body or disposed on one of the superficial layers of the resin body.

5 Claims, 12 Drawing Sheets

U.S. PATENT DOCUMENTS

| | | | | |
|---|---|---|---|---|
| 6,263,532 | B1 * | 7/2001 | Miller | 5/690 |
| 6,682,494 | B1 * | 1/2004 | Sleichter et al. | 601/57 |
| 6,953,439 | B1 * | 10/2005 | Kabemba | 601/47 |

FOREIGN PATENT DOCUMENTS

| | | |
|---|---|---|
| JP | 63-5788 | 1/1988 |
| JP | 2-211000 | 8/1990 |
| JP | 01-314919 | 7/1991 |
| JP | 06-198397 | 3/1996 |
| JP | 11-229572 | 8/2000 |
| JP | 2001-85681 | 3/2001 |
| JP | 2001-86580 | 3/2001 |
| JP | 2001-074503 | 9/2002 |
| JP | 2001-158042 | 12/2002 |
| JP | 2003-47080 | 2/2003 |
| JP | 2002-052420 | 9/2003 |

* cited by examiner

Method 1

Method 2

Method 3

CUSHION AND ACOUSTIC SYSTEM WITH THE CUSHION

BACKGROUND OF THE INVENTION

1. Field of the Invention

The present invention relates to a cushion comprising speakers and a sonic system comprising the cushion, though not limited thereto, more particularly relates to a cushion comprising the speakers suitable to use for machines or apparatuses to support all of or a part of human body in a condition of seated or laid down on such as various chairs or a seat for automobile, a seat and a bed for aircraft (hereinafter referred to as "the human body supporting part"). the cushion is applied to the human body supporting part, and relates to the cushion comprising a speaker for obtaining sound effects including sound pressure from the speaker and bodily sensation of wave can be obtained while maintaining cushion property and the sonic system comprising the cushion.

2. Description of Related Art

For a purpose for obtaining sound effects, relaxation music appreciation, or the like, various sonic systems constituted so as to enjoy music or sound effects running from the speakers in a condition of laid down on the bed or seated on the chair by incorporating the speakers in the bed or the chair have been suggested.

As such a sonic system, a body sonic apparatus to enjoy sound not only through the sense of hearing but also through bodily sense such as sound pressure or vibration is developed. As an example, as disclosed in Japanese Patent KOKAI (LOPI) No. 2-211000, Japanese Patent KOKAI (LOPI) No. 2001-86580, Japanese Patent KOKAI (LOPI) No. 2001-86581 and Japanese Patent KOKAI (LOPI) No. 2003-47080, a body sonic apparatus in which speakers and a vibration system such as a vibration transducer is incorporated is used for music appreciation, music therapy, relaxation or the like.

The reason why the body sonic apparatus is used by such applications is that it is said that body sonic appeals to emotion and instinct of a person, thereby provide sense of deep bass, rhythm, energy and intoxication, while sound heard from ear appeals to conscious and logical aspects. Thus, it is thought that comfort such as relaxation and sense of intoxication can be obtained by such body sonic.

In particular, relaxation effects by body sonic are desired for solving computer-related techno-stress which has been increased in late years, in addition, application of body sonic to a remedial field such as musical therapy and psychosomatic medicine, and use for alleviating pain on the occasion of artificial dialysis or dental treatment is also examined.

At the present, as described above, a cushion used for a bed, a chair, seats for automobile and/or aircraft mainly made from polyurethane foam, and in a conventional sonic system in which speakers are incorporated in the cushion, generally, the speakers are disposed at a regular interval to the urethane foam.

In the sonic system, since the urethane foam generally employed as the cushion lacks permeability, there is a problem that sound effect is suppressed or sound becomes unclear. Thus, though the speaker is disposed at a regular interval to the urethane foam as described above, there is a problem that a seat or a bed using the cushion becomes thick needlessly.

In addition, when a sound (wave) generated by the speaker is transferred through air, the wave is hard to be sensed bodily, on the other hand, when large sound volume enough to be sensed bodily and clearly is output by the speaker, an eardrum is stimulated excessively, accordingly it might bring discomfort.

On the other hand, in order to obtain "comfort" such as relaxation or sense of intoxication by wave and/or vibration in such the body sonic apparatus, the apparatus to generate wave and vibration which are easy to be sensed in a human body may be provided as well as the speaker, however, addition of such apparatus complicates a structure of the whole sonic system results in an expensive cost.

More particularly, when sound is sensed bodily by sound pressure and wave, in a case that sound is recognized by bone conduction, a part of the bone which is easy to resonant with sound is different according to audio frequencies, for example, a high-pitched tone is resonant with a parietal bone, and a low-pitched tone is resonant with a pelvis, therefore, sound is hard to be sensed bodily without suitably selecting a part of a human body to which sound (including sound pressure and wave) is transferred per audio frequencies, in addition, relaxation and sense of intoxication are hard to be obtained.

To solve the problem, an object of the present invention is to obtain a cushion function and suitable sound effects and a sound pressure effect by using a resin body with a spring structure having a permeability comprising a three-dimensional structure comprising voids of predetermined bulk density without giving sense of incongruity generated by speakers to a human body and avoiding impact from an outside to the speaker at the same time.

In addition, the other object of the present invention is to provide a cushion comprising speakers of which relaxation effect or a feeling of intoxication can be easily obtained through bodily sensation by undulation or sound pressure or the like, and a sonic system comprising the cushion.

SUMMARY OF THE INVENTION

To achieve the object, a cushion 20 is characterized by comprising:

a resin body with a spring structure 10 comprising a three-dimensional structure including voids at a predetermined bulk density, the three-dimensional structure being obtained by contacting, entwining, and gathering adjacent ones of random loops or curls of continuous filaments made from a thermoplastic resin in such a manner as to allow the resulting structure to have a layered structure in which layers composed of the filaments having a high bulk density as superficial layers are formed on a front and a rear of the resin body with the spring structure in a lengthwise direction, and a layer composed of the filaments having a low bulk density as a core layer is interposed between the superficial layers, wherein the resin body with the spring structure supports at least an upper half of a human body when using the cushion; and a speaker incorporated in the resin body with the spring structure or disposed on one of the superficial layers of the resin body with the spring structure 10.

In the cushion 20, a bulk density of the superficial layer of the resin body with the spring structure 10 has a bulk density of 0.2 to 0.5, preferably, 0.3 to 0.4 g/cm$^3$, void ratio of 44 to 77%, preferably, 56 to 67%, and the core layer of the resin body with the spring structure 10 has a bulk density of 0.01 to 0.15 g/cm$^3$, preferably, 0.03 to 0.05 g/cm$^3$, and void ratio of 83 to 99%, preferably, 94 to 97%.

Preferably, all or a part of filaments composing the resin body with the spring structure is hollow.

Furthermore, a plurality of the speakers having different sound frequency to be output may be disposed so that the sound frequency to be output is lowered from a head to a lower half of the human body.

Furthermore, it is preferable that the speaker disposed on a rear of a belly of the human body to output a low-pitched tone may be provided as well as the speaker disposed on a back of a chest of the human body to output a high-pitched tone according to the arrangement position of the human body when using the speakers.

In addition, a sonic system of the present invention comprises a structure on which any of the cushions previously described is disposed on a back supporting part of a human body supporting part such as a chair, seats and beds for automobile and or aircraft or the like comprising the back supporting part such as a backrest for supporting at least a back of the upper half of the human body.

The cushion of the present invention can keep sound effects according to a permeability of a resin body with a spring structure of a three-dimensional structure itself, and contact or impact to the speaker by a human body can be prevented during a use of a cushion for a chair, seats or beds or the like for automobile and aircraft by a superficial layer having a high bulk density formed on a front and a rear of the resin body with the spring structure, further, sense of incongruity to a human body generated by the speaker can be completely eliminated.

In addition, in the cushion of the present invention, excellent fluidity of acoustic wave can be obtained by the permeability without generating repulsion or restraint of sound, thereby, bodily and/or mental relaxation provided by vibration with sound pressure can be obtained according to audio frequencies. Simultaneously, resonance vibration of the speaker itself can be restrained.

Furthermore, a resin body with a spring structure itself comprising the above-mentioned structure is functioned as a medium to conduct the wave generated in the speakers to a human body, therefore, wave conducted by using the resin body with the spring structure as a medium is conducted to a human body as well as conduction of the sound using air as a medium, thereby sound can be sensed bodily or recognized by a sense other than the sense of hearing such as a perception as vibration of wave or recognition of sound by bone conduction.

Therefore, even if sound of comparatively small sound volume is output by the speakers, the wave generated in the speakers can be conducted to a human body in a clear condition of which the wave can be bodily sensed by other than the sense of hearing, and the cushion and a sonic system allowing to sense sound bodily as vibration without providing a structure to generate vibration easy to be sensed in a human body separately excepting speakers can be provided.

In particular, when all or a part of filaments constituting the resin body with a spring structure is a hollow structure, conduction of a clear high-pitch range can be realized by internal air of the hollow filaments.

Furthermore, the present invention has an effect of prevention of noise by the three-dimensional structure, in addition, it can be molded as various shapes applicable to various applications. In addition, when incorporating the speaker, a recess to install the speaker in arbitrary form at a desired portion can be easily formed for example by heat press.

Furthermore, in the present invention, a superficial layer having a bulk density is formed on front and rear faces of the longitudinal direction by interposing a core layer having low bulk density of a resin body of a three-dimensional spring structure, therefore, it is possible to provide products which have a dense texture, are practically devoid of free cut ends, and have smooth surfaces having few undulations. It is possible to provide products which are excellent in pressure dispersion because the superficial layers are highly dense and the constitutive filaments thereof are firmly fused to each other. The product can have a small thickness, excellent cushion property, and resistance to collapse and repeated bending. Loops and curls in the superficial layers of a product are generally in parallel with a longitudinal direction (extruding direction) of the product, and they provide the product with an effective pressure dispersing activity. Loops in the core layer are practically in parallel with the thickness direction, thereby the cushion property of the product is improved.

In addition, a plurality of the speakers having different sound frequency to be output is disposed so that the sound frequency is lowered from a head to a lower half of the human body to be supported thereby, difference of audio frequencies easy to be conducted to each part of a human body (bone) and sound frequency (audio frequencies) output from the speakers can be corresponded to recognize clear sound by bone conduction and easily obtain the above-mentioned relaxation and sense of intoxication or the like easy can be easily conducted.

Further, by providing these speakers in an area corresponding to a range of which a human body is disposed when using the speakers. Sound pressure or wave (vibration) generated by the speakers can be easily conducted to a human body.

Further, comfortable frequency of vibration is different according to a part of a human body. For example, vibration having comparatively high frequency is comfortable to the chest, while vibration having comparatively low frequency is comfortable to the belly. Therefore, for example by arranging speakers outputting a high-pitched tone on the back of the chest of a human body while arranging speakers outputting a low-pitched tone on a rear of the belly of a human body, deeper relaxation and sense of intoxication or the like can be obtained.

According to the effect obtained by the cushion of the present invention, in the present invention, sonic wave without distortion is resonated on a hard superficial layer of such a resin body with a spring structure, thereby a sonic system of which a resin body with a spring structure itself is unitedly acted as a part of speakers can be constructed. A clear high-pitch range can be realized by air in hollow filaments of the resin body with the spring structure. Though hearing ability by the eardrum is declined as growing older, a tone hard to be heard generally can be clearly heard by recognizing the tone by bone conduction through the resin body with the spring structure. When music is appreciated by such a sonic system, a tone of each musical instrument secures high tone quality to sound clearly. In addition, when movies or the like are appreciated, the English scripts hard to be heard are easy to be heard as well as enjoy stereoscopic sound, therefore, tiredness is hard to be felt. It can be used as a practice appliance to improve ability by increasing sensitivity of musicians, people taking language rehabilitation. Musicians can feel sound bodily as if they play musical instruments by bone conduction through the resin body with the spring structure, for example, violinists identifies vibration transmitted from a jawbone to a brain, while, pianists hears a tone from a foot by bone conduction. As a result, sensitivity of a musician or the like can be improved.

Even more particularly, in the present invention, to massage spinal cord and internal organs by slight vibration, i.e., wave, blood circulation is improved thereby relaxation of mind and body can be obtained. A new effect to care and a medical site are also expected, then development of a study concerning wave medicine can also be expected. When applied to seats of automobile or the like, it is effective for careful driving or a recover of fatigue according to relaxation effect of the present invention by improving sound quality. It is said that to listen comfortable music itself is effective to obtain relaxation. Therefore, a new sonic system which can contribute to healthy life environment can be provided.

DETAILED DESCRIPTION OF THE PREFERRED EMBODIMENTS

An embodiment of the present invention will be described below with reference to the attached drawings.

1. Sonic System

A cushion 20 of the present invention is used by disposing on the back supporting part provided on the human body supporting part of a chair, a bed, seats of automobile and aircraft as an example, thus, a sonic system of the present invention is constituted by a human body supporting part of which the cushion 20 of the present invention is disposed on the back supporting part.

In addition, the back supporting part is a part supporting a back portion of at least an upper half of the human body provided on the human body supporting part, and if the human body supporting part is the above-mentioned chair or seat, as an example, the backrest part is equivalent to the back supporting part.

Figure 1:
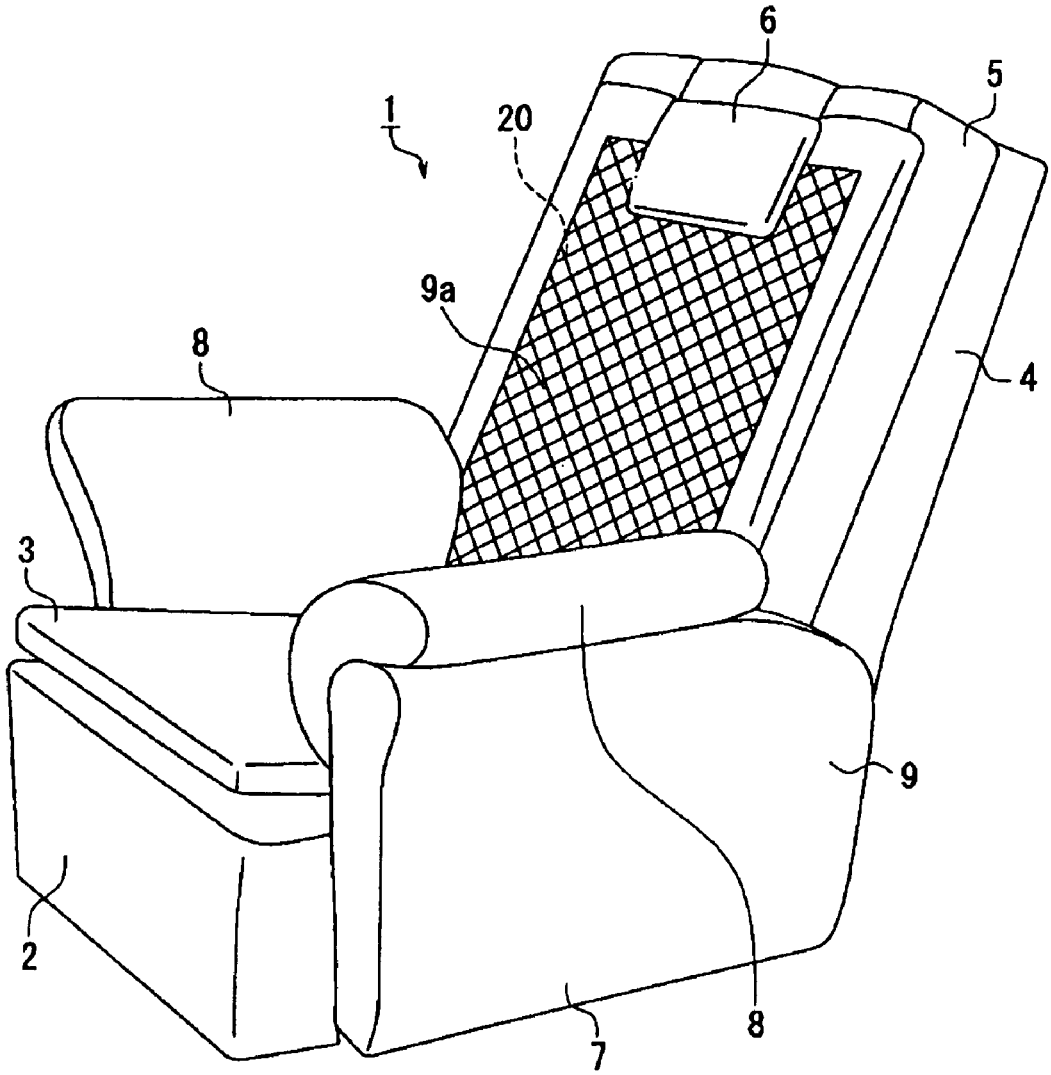
FIG. 1 shows an exterior perspective view of a sofa applying the cushion 20 of the present invention.

As one embodiment to show a sonic system of the present invention, an example of which this sonic system is embodied in a chair (sofa) is shown in FIG. 1.

In FIG. 1, a sofa 1 which is the human body supporting part constituting the sonic system comprises: a seat 2, a sheet cushion 3 put on the seat 2, a back 4 extended obliquely backward from the seat 2, a back cushion 5 covering a front of the back 4, a pillow 6 fixed to the back cushion 5, side face parts 7 extended from both sides of the seat 2 upwardly, armrests 8 fixed to the upward of the side parts 7, and a cover 9. In the sofa 1, the cushion 20 later described comprising a resin body with a spring structure 10 cut in a predetermined-shape is accommodated in the back cushion 5 constituting the back supporting part for supporting the back side of the upper half of a human body when seated.

In the present embodiment, in a covering which covers the back cushion 5, a part on which a back of the upper half of a human body is touched when seated is denoted as a net 9*a*, and the net prevents sound, sound pressure, vibration or the like generated from speakers installed on the cushion 20 from being conducted to a human body.

Figure 2:
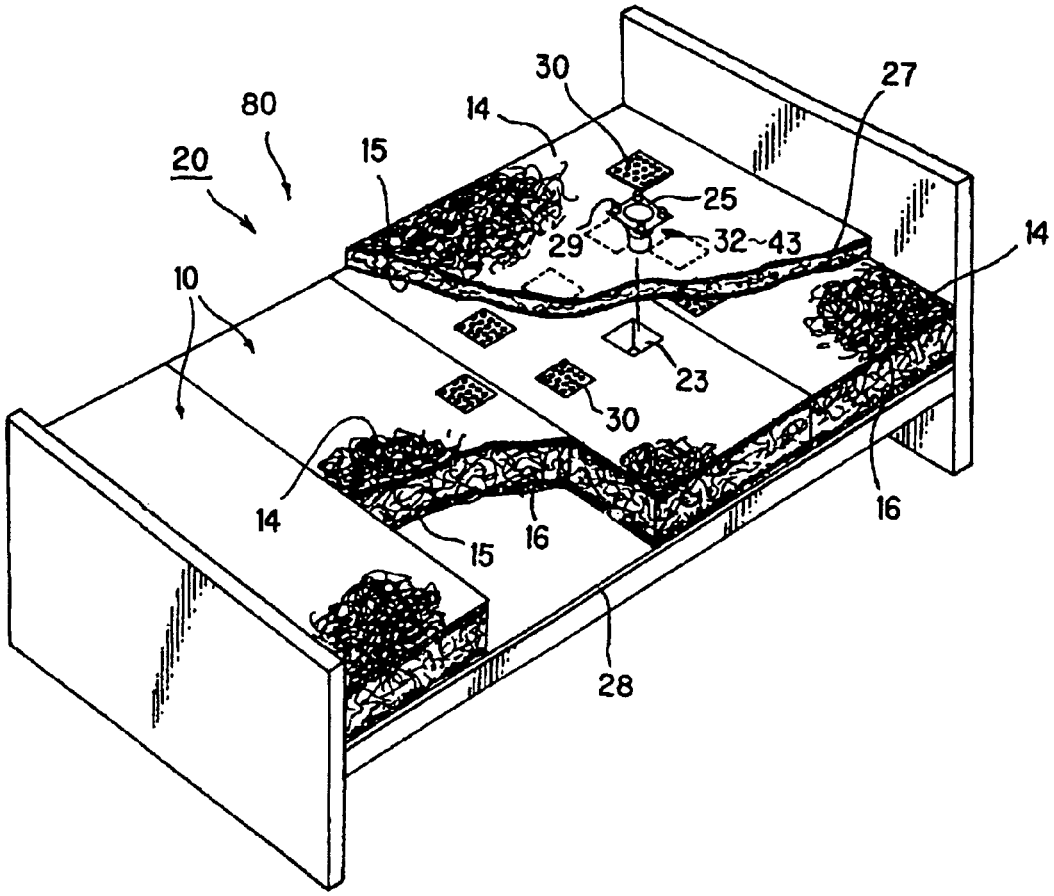
FIG. 2 shows an exterior perspective view of a bed applying the cushion 20 of the present invention.

In addition, FIG. 2 is an example of which this sonic system is realized in a bed. In the bed, the back of the person who laid on its side is supported by the cushion materials put on the bed, and in the illustrated embodiment, instead of general cushion materials, the cushion 20 of the present invention comprising the resin body with the spring structure 10 and speakers described below is put on the bed The cushion 20 is disposed on the bed 80 by spreading a rubber seat having thickness around 1 to 3 mm on a floor of the bed 80 such as a veneer plywood in general, then putting the resin body with the spring structure installing speakers 32 to 43 on the seat.

2. Cushion

As described above, the cushion 20 of the present invention used by combining with the human body supporting part is constituted by the resin body with the spring structure 10 and speakers supporting an upper half part of the human body when used. The cushion 20 can be constituted as described below as an example.

2-1. Resin Body with a Spring Structure 10

In the present embodiment, the resin body with the spring structure 10 supporting at least upper half of the human body a back side when used is a three-dimensional structure with voids obtained by contacting, entwining, and gathering random continuous filaments 12 (hereinafter also simply referred to as "filaments 12") made from or primarily from a thermoplastic resin. The filaments 12 take the form of loops, and adjacent loops of the filaments contact, entwine and gather with each other.

The thermoplastic resin may be general purpose plastics (polyolefins, polystyrene resins, methacryl resins, poly vinyl chloride, etc.) or engineering plastics (polyamide, polycarbonate, saturated polyester, polyacetal, etc.). For example, they are preferably made from thermoplastic elastomers such as polyethylene (PE hereinafter), polypropylene (PP hereinafter), PVC, or nylon. Hollow parts may be placed intermittently.

The bulk density of the whole resin body with the spring structure 10 is 0.001 to 0.20 g/cm$^3$.

Preferably, the bulk density of the resin body with a spring structure 10 may be 0.08 to 0.20 g/cm$^3$, more preferably 0.10 to 0.18 g/cm$^3$. The void ratio of the resin body with a spring structure 10 may be 78 to 91%, more preferably 80 to 88%. The resin body with a spring structure 10 comprises front and rear superficial layers 14 and 15 with a core layer 16 in between. The bulk density of each superficial layer may be 0.2 to 0.5 g/cm$^3$, preferably 0.3 to 0.4 g/cm$^3$. Its void ratio may be 44 to 77%, preferably 56 to 67%. The bulk density of the core layer may be 0.01 to 0.15 g/cm$^3$, preferably 0.03 to 0.05 g/cm$^3$. The void ratio of the core layer may be 83 to 99%, preferably 94 to 97%.

The diameter of the filaments constituting the resin body with a spring structure 10 may be 0.3 to 3.0 mm, preferably 0.7 to 1.0 mm when the filaments are solid filaments. If the solid filaments had a diameter equal to or smaller than 0.3 mm, the filaments would lose resiliency and fusion of adjacent filaments occurs so frequently that the void ratio of the resin body would become undesirably low. On the contrary, if the solid filaments have a diameter equal to or larger than 3.0 mm, the filaments would become so resilient that they would not form loops, nor fuse with each other which would lead to the lowered strength. The diameter of the filaments constituting the resin body with a spring structure 10 may be 1.0 to 3.0 mm, preferably 1.5 to 2.0 mm, most preferably 0.9 to 1.3 mm, when the filaments are hollow. The hollow ratio of each hollow fiber is preferably 10 to 80%. If the hollow ratio was equal to or lower than 10%, the hollow filaments would lose the merit of reducing the weight of the product. On the contrary, if the hollow ratio was equal to or higher than 80%, the hollow filaments would have a reduced cushioning property.

Thickness of the resin body with the spring structure 10 is not limited in particular if necessary strength and deformation properties enough to support a human body can be performed, however, when the speaker is incorporated, the resin body with a spring structure 10 is formed to a necessary thickness to have speakers incorporated, and as an example, the thickness is 60 mm to 100 mm, preferably, 70 to 80 mm. A final geometry of the resin body with the spring structure can be optionally formed with fusion, mechanical cutting or hot press.

A void ratio of the resin body with a spring structure 10 may be in the range described below, to maintain its elasticity and strength as long as it exists as a three dimensional structure having a void with a predetermined bulk density, as well as to reduce its weight. Here, void ratio will be decided by the following formula.

$$[\text{Void ratio } (\%)]=(1-[\text{bulk density}]/[\text{density of resin}])\times 100.$$

Filaments constituting the resin body with the spring structure 10 may be hollow, solid or a mixture thereof, and in particularly, it is preferable to use the hollow filament since air in the filament enabling conduction of a clear high-pitch range. A mixture of solid filaments and hollow filaments is used as a material of the filaments constituting the resin body with the spring structure 10, the mixing ratio of solid filaments to hollow filaments is preferably 0 to 50:50 to 100.

Furthermore, if hollow filaments are placed at the core, and surrounded by solid filaments around the resulting resin body with a spring structure will be desirable because it will give an agreeable touch feel.

The thermoplastic resin serving as a material of the resin body with the spring structure 10 includes particularly preferably polyolefin resins such as polyethylene (PE), polypropylene (PP), etc. A vinyl acetate resin (VAC hereinafter), ethylene vinyl acetate copolymer (EVA hereinafter), or styrene butadiene styrene (SBS hereinafter) is preferably used, or a mixture of them may be used. The polyolefin resin may include recycled resins.

The thermoplastic resin is preferably made from a mixture obtained by combining two or more chosen from polyolefin resins, vinyl acetate resins, ethylene vinyl acetate copolymers and styrene butadiene styrene.

The resin body with a spring structure 10 preferably comprises a three-dimensional structure made from a mixture (e.g., thermoplastic elastomer) obtained by mixing a polyolefin resin such as PE or PP with VAC, EVA or SBS.

The mixing ratio of a polyolefin resin to VAC or EVA in terms of the weight of vinyl acetate of the latter may be 70 to 97 wt %:3 to 30 wt %, preferably 80 to 90 wt %:10 to 20 wt %.

If the VAC or EVA content were equal to or lower than 3 wt %, the impact resilience of the three-dimensional structure would be reduced. On the contrary, if the VAC or EVA content were equal to or higher than 30 wt %, the thermal stability of the three-dimensional structure would be impaired.

The mixing ratio of a polyolefin resin to SBS may be 50 to 97 wt %:3 to 50 wt %, preferably 70 to 90 wt %:10 to 30 wt %.

2-2. Installation of the Speakers to the Resin Body with the Spring Structure 10

(1) Incorporating in the Resin Body with a Spring Structure 10

Figure 3:
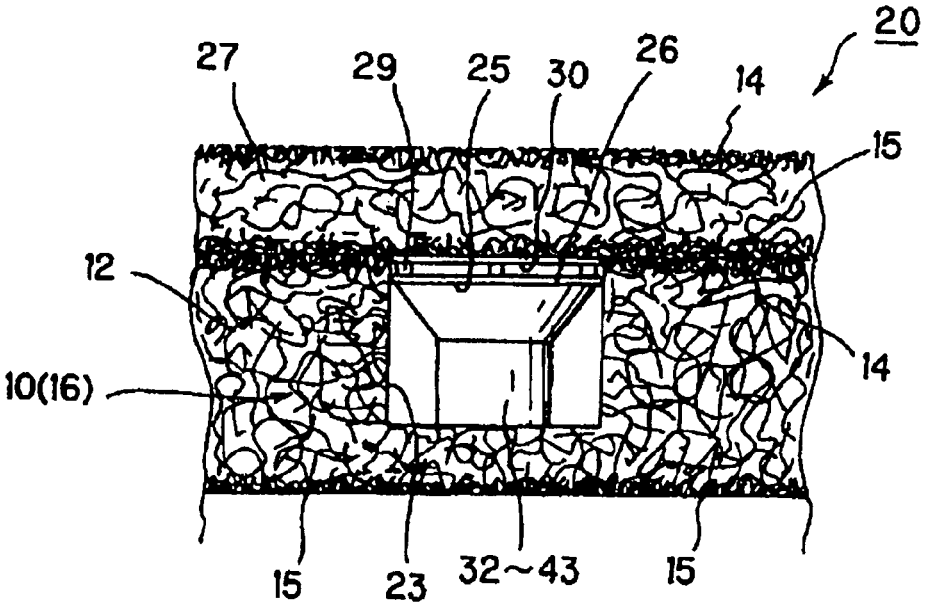
FIG. 3 shows a longitudinal sectional view illustrating an installation example of the speakers 32 to 43 to the cushion 20.

For installation of the speaker 24 to the resin body with a spring structure 10, a cavity 23 having a size of outer periphery (rim) of a frame 25 of the speaker 24 on either of front or rear superficial layer 14, 15 of the resin body with the spring structure 10, here as shown in FIG. 3, on the superficial layer 14, so that a cone paper 26 of the speaker 24 is faced to a surface of a human body side of the resin body the spring structure.

The cavities 23 are formed by pressing a resin body with a spring structure surface 14 (,15) with a press face having a shape same shape of a frame outer circumferential geometry at an arbitrary angle. In consideration of directivity from a surface sound source of the speaker and, it is not necessary to be a right angle to the resin body with a spring structure, an angle may be changed according to applications, and the installation number is also arbitrary.

In addition, in order to secure a more smooth frequency characteristic, components having various sizes corresponding to audio frequencies may be disposed.

In the press work, the superficial layer 14 having high a bulk density is maintained on a base of the cavity 23 in a press direction, while filaments 12 of the resin body with the spring structure 10 is fused by pressing on the sides of the cavity 23.

The speaker 24 can be optionally wired from sides of the resin body with the spring structure 10 or insertion holes provided on the rear superficial 15 through a core layer 16 having a low bulk density.

In addition, the speaker having desired sizes and characteristics can be employed.

In FIGS. 2 and 3, rubber cushion pieces 29 are adhered to four point of a periphery of a frame 25 of the speaker 24, and here, an aluminum punching metals 30 are bonded on the rubber pieces 29.

In addition, in FIGS. 2 and 3, 27 denotes a sheet cushion which is formed in the same manner of the resin body with the spring structure 10, then spread on the resin body with the spring structure 10 to keep a distance between the speaker and the human body and protect the speaker and the human from the contact and impact.

In addition, a thickness of the resin body with the spring structure is 70 mm and the thickness of the sheet cushion 27 is 30 mm, and a depth of the cavity 23 for the speaker is 50 mm.

Without limiting to the case when the cavity is formed from a rear face of the resin body with the spring structure 10, to pursue more improved sound effects, a box containing the speaker 24 may be contained in a box (not shown) made of plastic or the like for holding the speaker 24, then the box may be installed in the cavity 23.

(2) Installation on an Outside of the Resin Body with the Spring Structure 10

Figure 4:
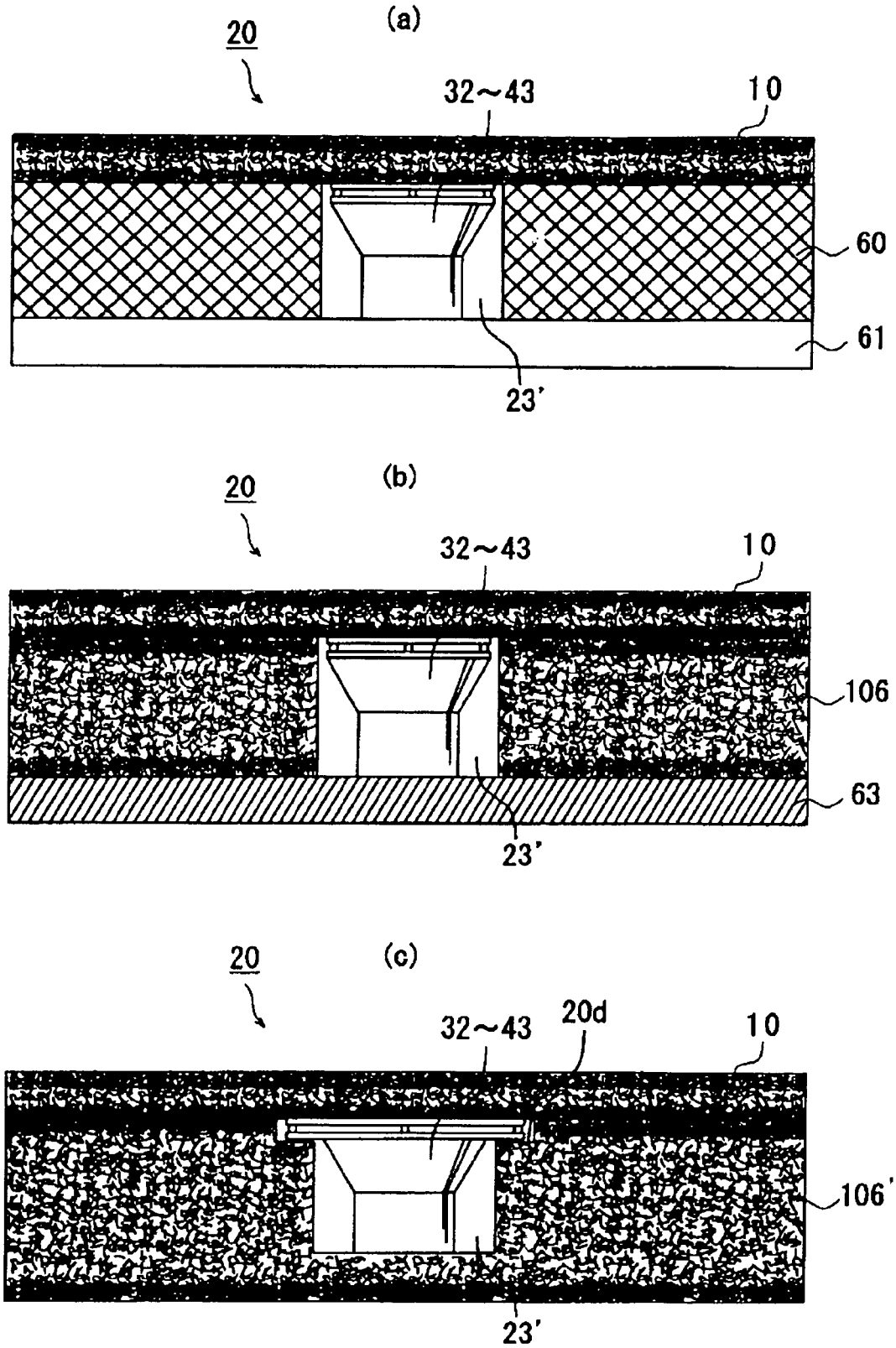
FIG. 4 shows a longitudinal sectional view illustrating installation examples of the speakers 32 to 43 to the cushion 20, and (*a*) (*b*) (*c*) are respectively different installation examples.

Each of the above-mentioned speakers may be constituted so that for example, an embedded plate 60 comprising the cavity 23' is put on a base plates 61 and, speakers 32 to 43 are contained in the cavity 23', then the resin body with the spring structure 10 is put on the embedded plate 60, thereby the speakers 32 to 43 are oppositely disposed on one side (a rear face) of the resin body with the spring structure 10 as shown in FIG. 4, as well as that each of the speakers are contained in the cavity 23 formed in the resin body with a spring structure 10 as described with reference to FIGS. 2, 3.

Various materials such as a plastic plate, a honeycomb structure, iron, a plywood may be used for the embedded plate 60 and the base plates 61 used herein. Further, as shown in FIG. 4(*b*), an embedded plate 106 may be constituted by a three-dimensional structure with voids obtained by contacting, entwining, and gathering random loops or curls of continuous filaments made from a thermoplastic resin, preferably the three-dimensional structure having the same structure of the resin body with the spring structure 10.

Further, the embodiment shown in FIG. 4(*c*) illustrates an example that an embedded plate 106' having functions of the base plates 61, 63 in the embodiment shown in FIGS. 4(*a*) and 4(*b*) is formed by the three-dimensional structure.

In a structure shown in this FIG. 4(*c*), the cavity 23' is formed as the bottomed aperture having a predetermined depth, however, the cavity 23' may be composed as a through hole. Further, in the embodiment shown in FIG. 4(*c*), a flange protruding from a periphery is provided on the speakers 32 to 43, and the speakers 32 to 43 are fixed in the cavity 23' by engaging the flange on an opening edge of the cavity 23'. In this case, by forming a step portion 20*d* with which the flange is engaged on an opening edge of the cavity 23', a gap between the resin body with the spring structure and the embedded plate 106' is prevented from being generated when the resin body with the spring structure is put on the embedded plate 106'.

Further, in structures shown in FIG. 4(*a*) and FIG. 4(*b*), a structure of which a step portion 20*d* is provided at an opening edge of the cavity 23 may be adopted as well as a flange protruding from a periphery of the speakers is provided in such manner. When the structure is employed, it is not necessarily to provide the base plates 61, 63.

In addition, when the embedded plate 106, 106' are three-dimensional structures similar to the resin body with the spring structure, the cavity 23' can be formed with a method or a state same as those described with reference to FIG. 3.

2-3. Types of Speakers and Arrangement Thereof

Figure 5:
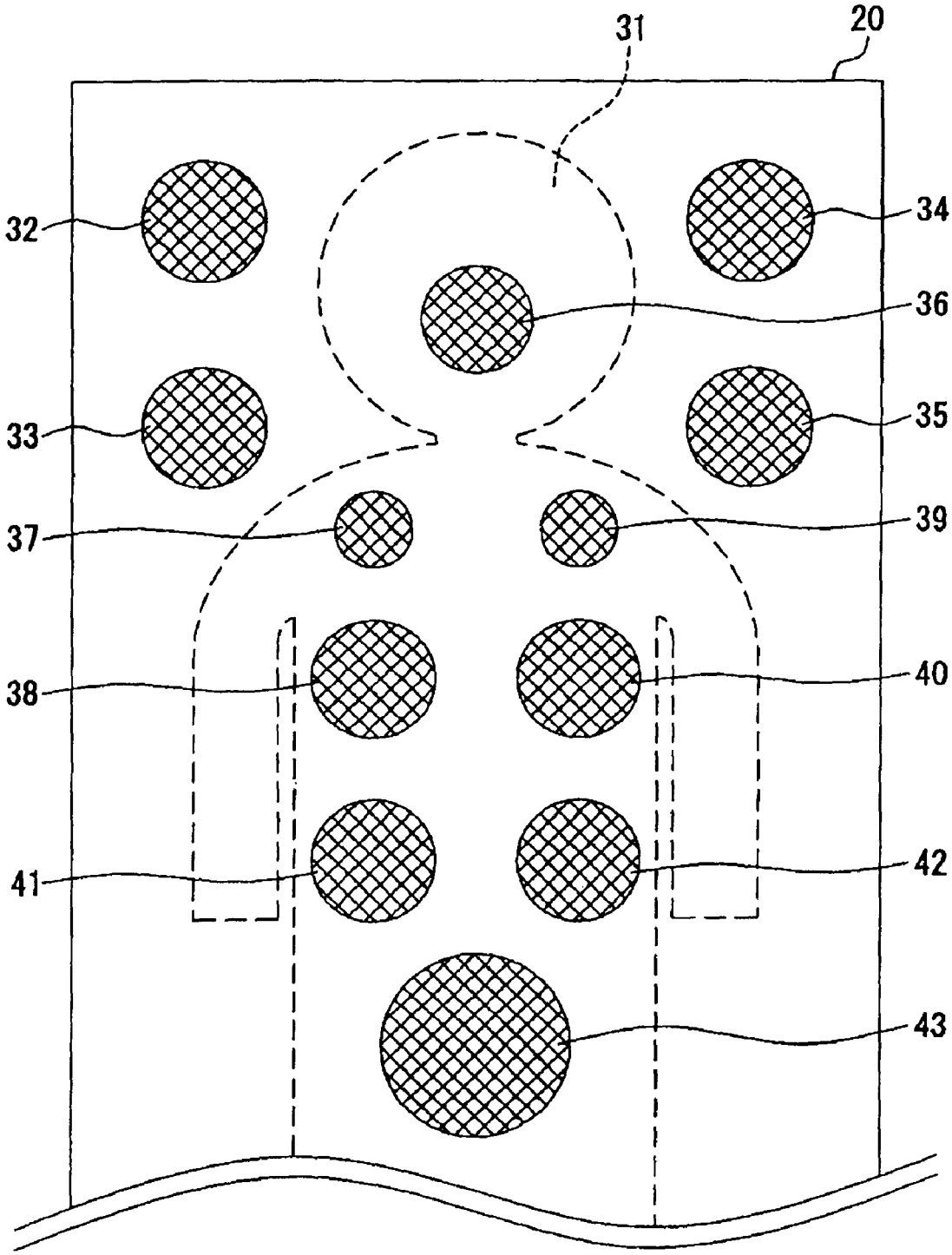
FIG. 5 shows an explanatory view illustrating an arrangement example of the speaker to the cushion 20.
Figure 6:
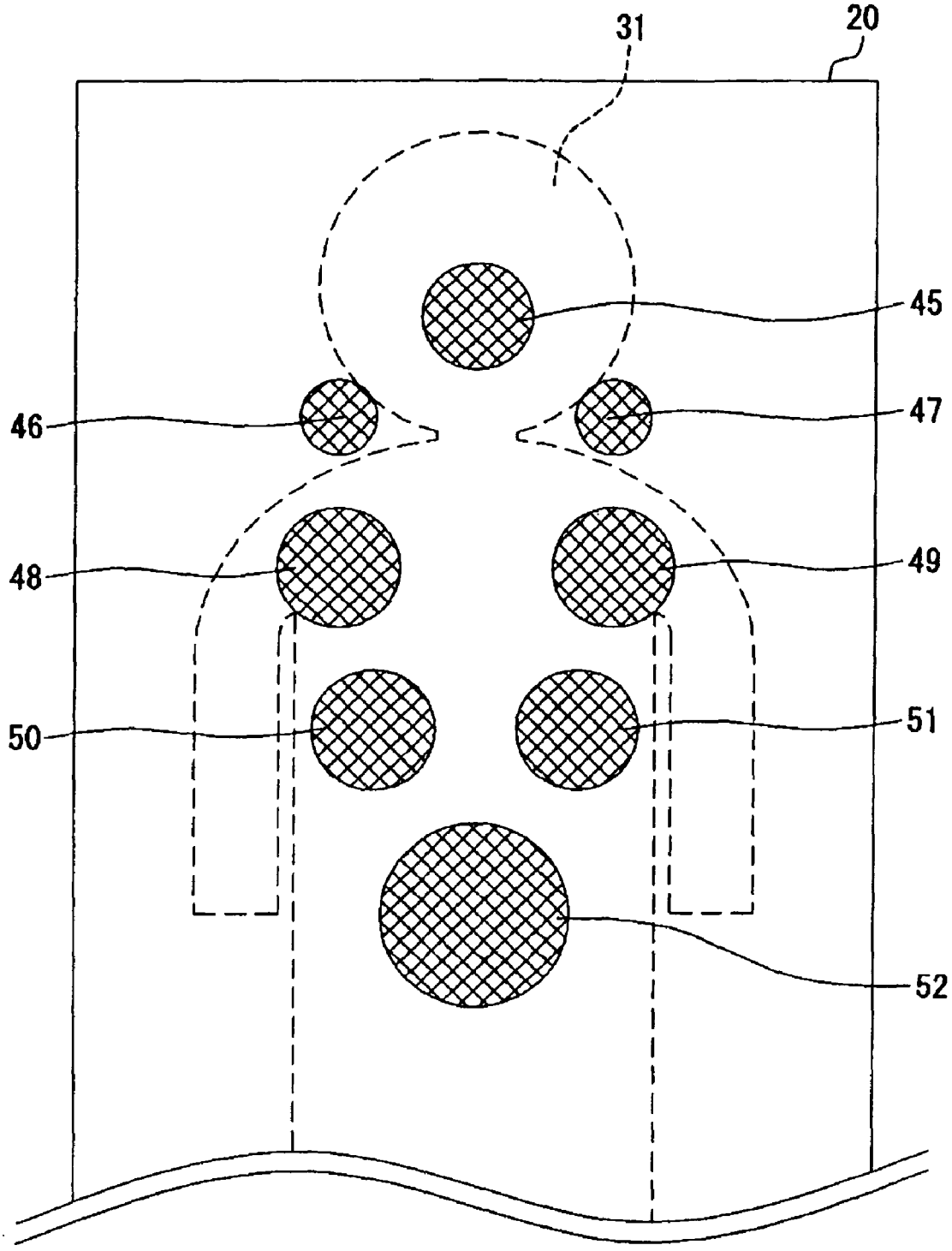
FIG. 6 shows an another explanatory view illustrating an arrangement example according to the speaker to the cushion 20.

Next, with reference to FIG. 5 and FIG. 6, types and arrangement of speakers will be explained. In FIG. 5 and FIG. 6, the cushion 20 is disposed so as to support for example, at least a back side of an upper part of the human body when used. Dotted lines illustrated in FIGS. 5 and 6 shows a range that the back side is put on when a normal human body 31 is leaned back in the cushion 20 or when the human body is laid on the cushion 20 with turning over on the back.

In addition, in the following description, concerning as "upper" or "lower", a head side of a human body 31 is referred to as "upper" and a side of a lower part of the human body is referred to as "lower", if there is no explanation particularly.

In the illustrated embodiment, the cushion 20 comprises two pairs of upper speakers 32 to 35 disposed in the resin body with the spring structure 10 or at a rear face side of the resin body with the spring structure, a center speaker 36 disposed in a backside area of a head, speakers 37 to 42 disposed at the backside area of a part corresponding to the chest, and a speaker 43 disposed at a backside of a part corresponding to the belly of a human body at the both sides of the head of the human body 31.

Figure 7:
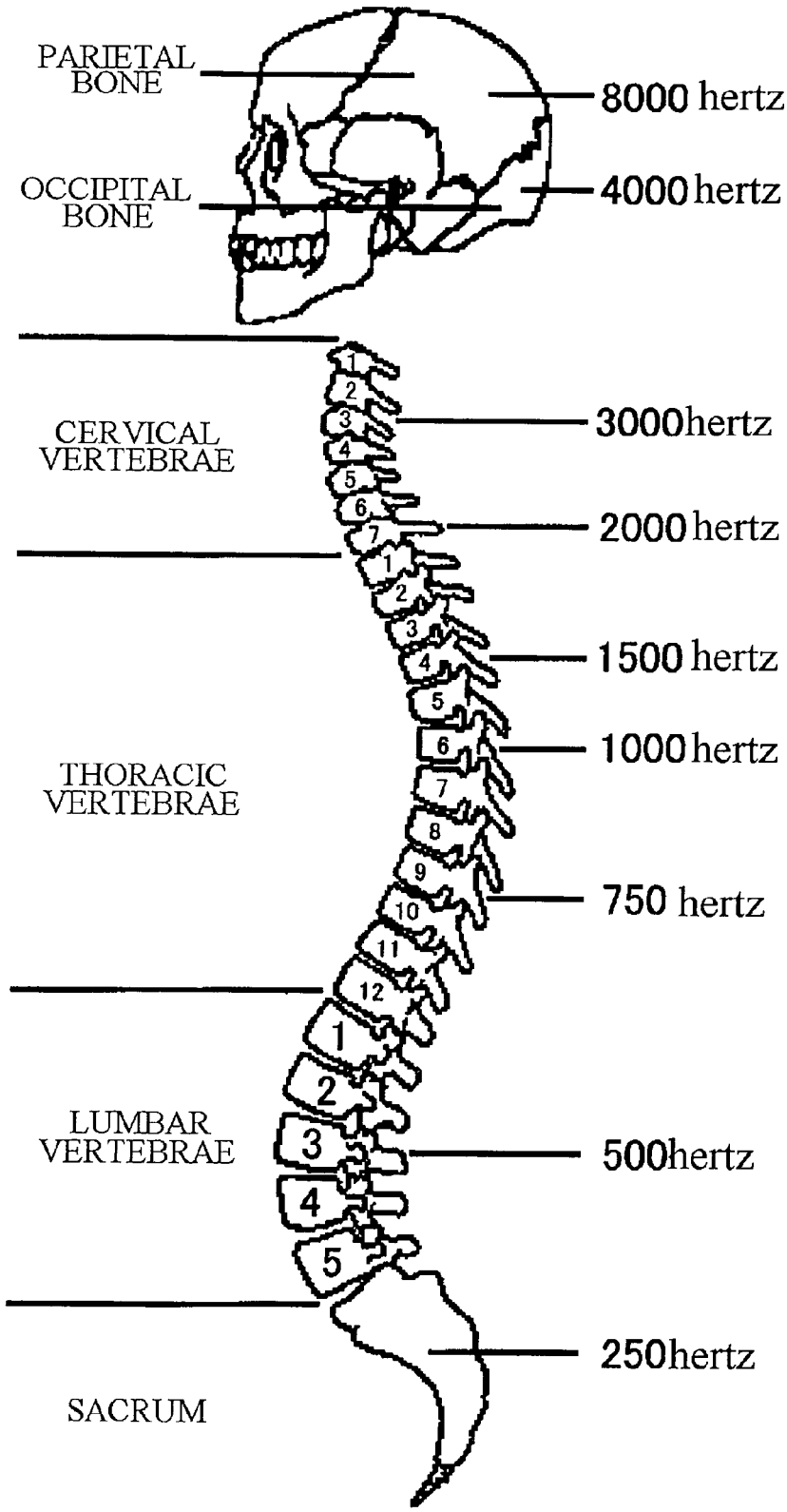
FIG. 7 shows an explanatory view illustrating a relationship between each part of a bone of a human body and a resonant frequency.

With respect to a range to dispose the speakers, it is preferable that the speaker 43 arranged at the lowermost end is disposed within a range of lumbar vertebrae shown in FIG. 7, and it is not preferable to lower the speaker 43 to a range of the sacrum.

It is desirable that a speaker, especially, a speaker disposed in an area corresponding to arrangement of a human body 31 as shown by a dotted line in particular are disposed so that sound frequency output from the upper to lower is lowered. In the embodiment, upper speakers 32 to 42 are connected to an amplifier section having rated output of 15 W and frequency characteristic of 150 Hz to 20 KHz (not shown). In addition, the speaker 43 is connected with an amplifier part having rated output of 25 W of and frequency characteristic of 20 Hz to 150 KHz (not shown). The speakers 43 is constituted so as to generate a low-pitched tone in comparison with the speakers 32 to 42. Such the low-pitched tone (low frequency sound) can directly vibrate a bone and/or internal organs, therefore sensuality of the human body is affected due to the low-pitched tone, thereby physiological pleasant feeling and massage effect can be obtained.

Sizes of speakers 37 to 43 are set (for example, a cone type of 8 cm) enough to be contained in a width of the region where the upper half of the human body is positioned (in here, 45 to 57 cm, i.e., width including a length of arms, preferably 25 to 37 cm, i.e., width of a chest), further, it is preferable to dispose the speakers 37 to 43 symmetrically to the backbone.

As other arrangement example of the speakers, as shown in FIG. 6, a speaker 45 is disposed on a backside of a head, speakers 46 and 47 are disposed on the both sides backside of a neck, speakers 48 to 51 are disposed on backsides of right and left of a chest, and a speaker 52 is disposed on a backside of a belly. Difference from a structure of FIG. 5 is that the speakers 46, 47 disposed out of an arrangement region of a human body 31 as shown in a dotted line in the head side is disposed near the head in comparison with the upper speakers 32 to 35 in FIG. 5.

As shown in FIG. 7, sound frequency appearing from speakers may be changed by using a characteristic of a bone conduction hearing ability in that resonated frequency is decreased from a cranium (a parietal bone) to the sacrum (from top to bottom). In other words, since the part of the bone of which a human body is resonated according to pitch of sound frequency, for example, in FIGS. 5 and 6, the speakers may be designed so that sound frequency emitted from speakers from upward to downward is gradually decreased. In other words, sound frequency from each speakers is varied according to a part of a bone of the upper half of human body to generate effective bone sound conduction. In addition, the more sound frequency is decreased, the more a degree of bodily sensation is increased.

3. Method of Use and Effect Thereof

In a sonic system comprising the cushion 20 of the present invention constituted in the above described manner, when the sonic system is embodied as a chair and seats of automobile aircraft or the like, a back of the upper half of human body is leaned on the back supporting part of a backrest or the like on which the cushion 20 is disposed in a condition to be seated in the chair or the seat or the like, or, when a sonic system is embodied as a bed or the like, by lying on its side on the cushion 20 put on the bed on one's back, the back of the upper half of human body is put on the cushion 20, then in the condition, music, sound effects, and other sound are generated from the speaker installed in the cushion 20.

The sound emitted from the speakers can be heard as clear sound without impairing sound effects by a permeability of the resin body with a spring structure 10 of a three-dimensional structure itself. In addition, excellent fluidity of acoustic wave can be obtained according to permeability of a resin body with a spring structure 10 without generating repulsion or restraint of sound, and a bodily and/or mental relaxation provided by vibration with sound pressure can be obtained according to audio frequencies.

In addition, a resin body with a spring structure 10 supporting a back of the upper half of human body is functioned also as a medium conducting sonic wave generated by the speaker to a human body, thereby, sonic wave generated by speakers vibrates a human body, especially a bone for enabling to feel sound bodily in response to a perception of the vibration, or perception of sound through bone conduction.

Vibration or the like generated by such a wave enables the person who employs a sonic system of the present invention to bodily sense "Comfort" such as relaxation effect and sense of intoxication or the like as well as appreciate music and other sound with clear sound by bone conduction without being affected by noise or the like of in environments.

Thus, according to the cushion of the present invention and the sonic system employing the cushion, recognition of sound and bodily sensation from two aspects, i.e., perception of sound or bodily sensation by vibration of air and perception and bodily sensation by conduction of wave with separate filaments constituting the resin body with the spring structure 10 as a media (for example, bone conduction) can be obtained By these synergistic effect, deeper bodily, mental relaxation and sense of intoxication or the like can be obtained.

As mentioned above, the cushion 20 of the present invention can be applied to a chair, a seat and a bed for automobile, aircraft, a movie theater, a beauty parlor, a coffee shop, a hotel, a live music house, various special events, a hall, a fitness club, hospitals or the like as well as the sofa and the bed or the like. Further, the cushion 20 of the present invention is applicable to medical care (artificial dialysis chair, a surgical table, a delivery table, a blood donation table, a dental chair or the like), further applicable to various fields such as a combination with music appreciation, musical practice, relaxation, picture media.

4. Manufacture of a Resin Body with a Spring Structure 10

4-1. Device for Molding a Resin Body with the Spring Structure 115

Figure 8:
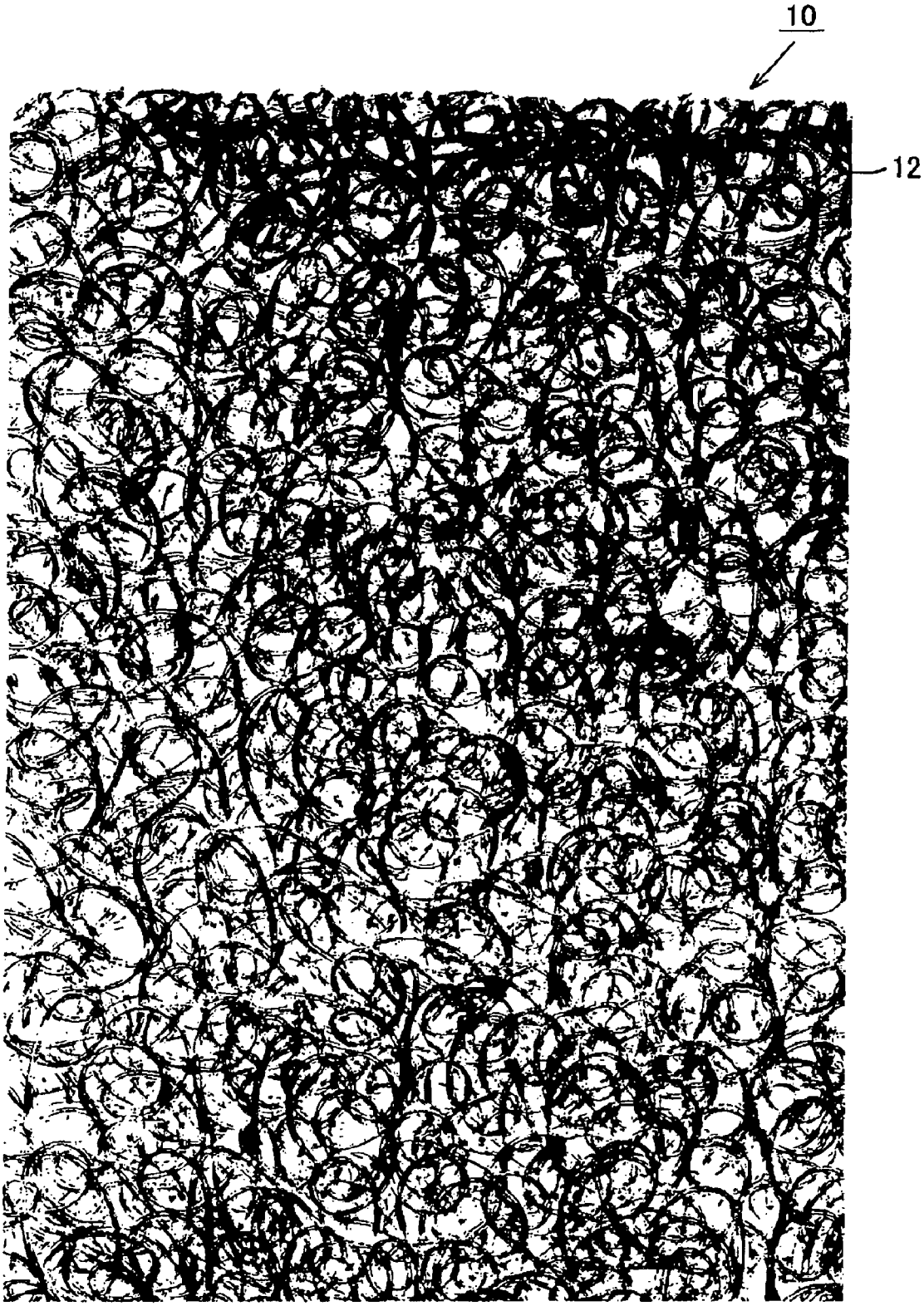
FIG. 8 shows an explanatory view illustrating a resin body with a spring structure 10.
Figure 9:
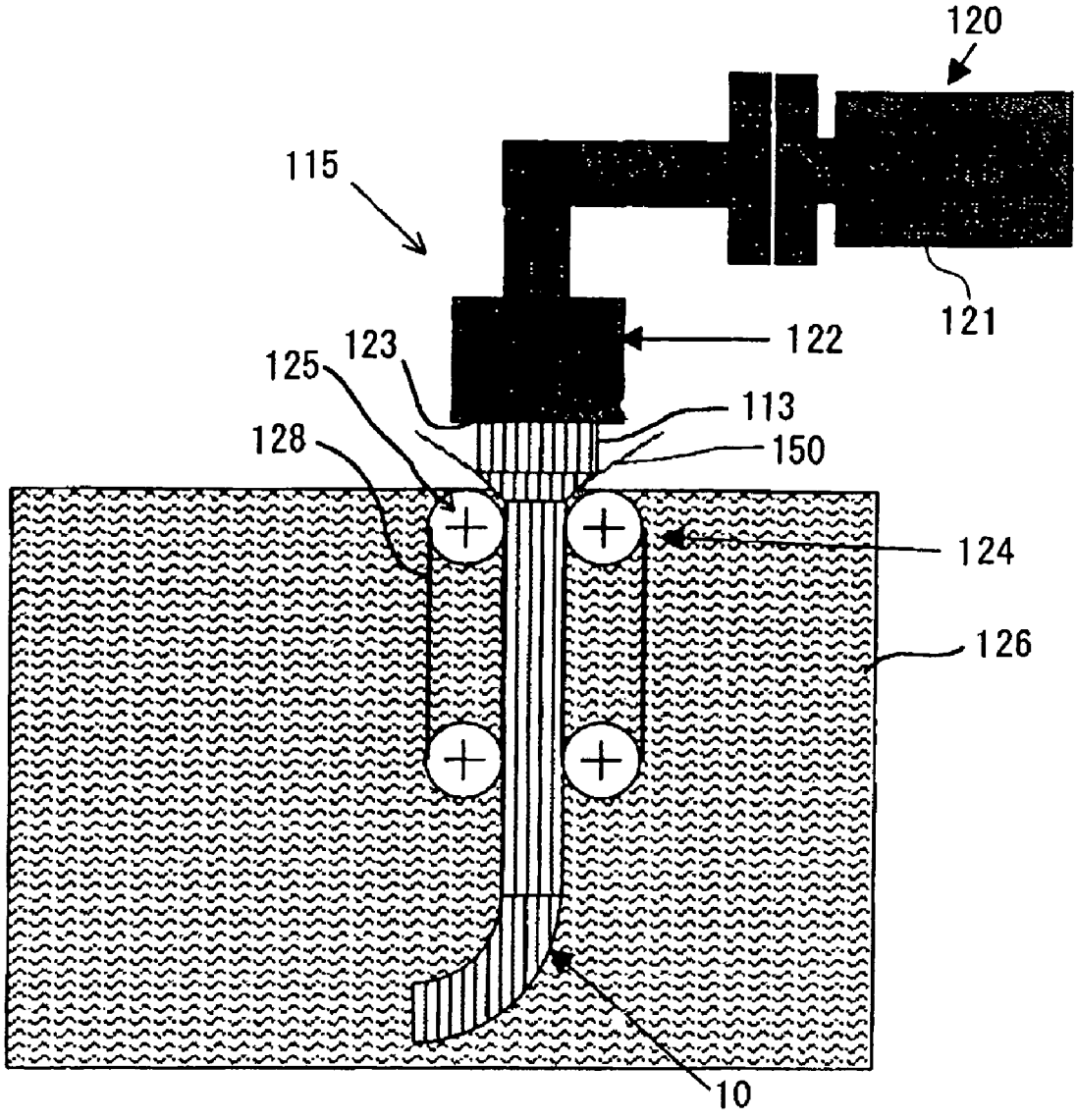
FIG. 9 shows an view illustrating a device for manufacturing a resin body with a spring structure.
Figure 10:
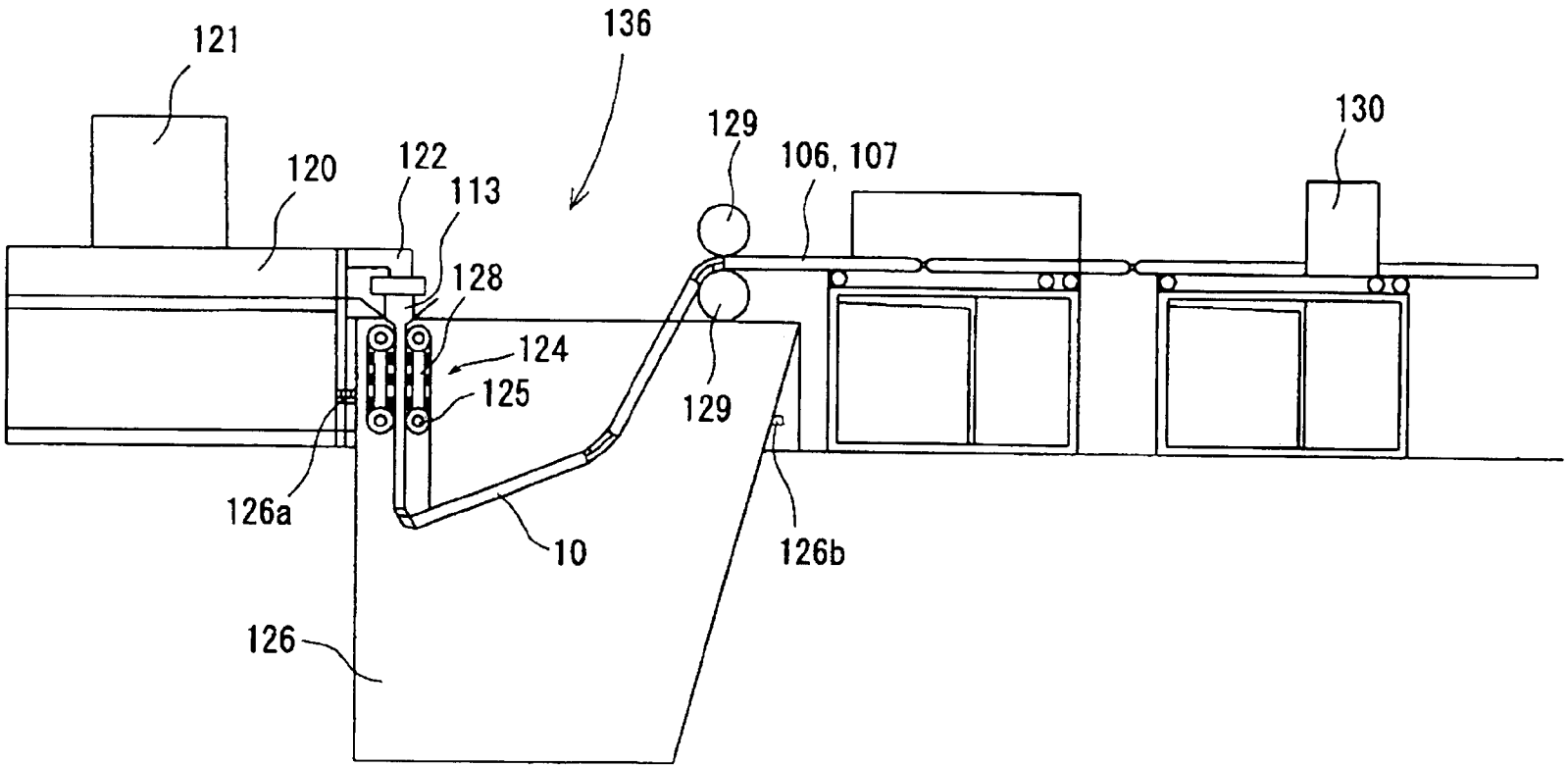
FIG. 10 shows an explanatory view illustrating another device for manufacturing a resin body with a spring structure.

An exemplary device for molding the resin body with the spring structure 115 representing an embodiment of a device for manufacturing a resin body with a spring structure 10 shown in FIG. 8 is described below. As shown in FIGS. 9 and 10, the system, i.e., an extrusion molding system 120 comprises a hopper 121. A thermoplastic resin is fed to the system via the hopper 121, melted after being heating to a predetermined temperature, kneaded and transferred into a molding die 122. The molten material is extruded at a predetermined speed through a plurality of nozzles 123, and filaments to constitute a bundle of filaments 113 are taken off by a winder 124.

Take-off rolls 125, 125 constituting the winder 124 are submerged under water in a bath 126. Each of the take-off rolls 125, 125 comprises a pair of upper and lower rollers connected with an endless belt 128. The bath 126 has a water inlet valve 126*a* and a water outlet valve 126*b*. A resin body with a spring structure 10 is prepared as follows: filaments 12 constituting a bundle of filaments 113 are formed into random loops, adjacent random loops are brought into contact each other to be fused, the random loops as fused together become solidified after being cooled in water, and the take-up rolls 129, 129 lift the thus produced resin body with a spring structure 10.

As seen from FIG. 10, if it is suspected that filaments constituting a resin body with a spring structure 10 comprising a three-dimensional structure are undesirably resistive to bending when they are taken off by the take-off rolls 125, 125, it is possible to deliberately prepare low-density portions which are more sensitive to bending across the three-dimensional structure at regular intervals. Then, it is possible to bend the resin body with a spring structure 10 at those low-density portions, after they are lifted from water. A cutting unit 130 is used to cut the resin body with a spring structure 10 lifted from the water into pieces having desired lengths. Now, description is given on a loop-forming unit 150. The loop-forming unit 150 is for increasing the density of loops of the resin body with a spring structure 10 by operating on melted continuous filaments 12 extruded from a die 122, that is, by restricting/compressing the thickness of the filaments before the filaments contact with water in a bath 126, to produce thereby the resin body with the spring structure 10 having dense loops. Furthermore, according to the loop-forming unit 150, it is possible to ensure the smooth formation of loops, and the uniform fusion of adjacent loops. Still further, according to the loop-forming unit 150, it is possible to solidify filaments before they contact with the surface of an endless conveyor belt 128, thereby preventing the surface undulation of the belt 128 from being printed on the filaments.

Figure 11:
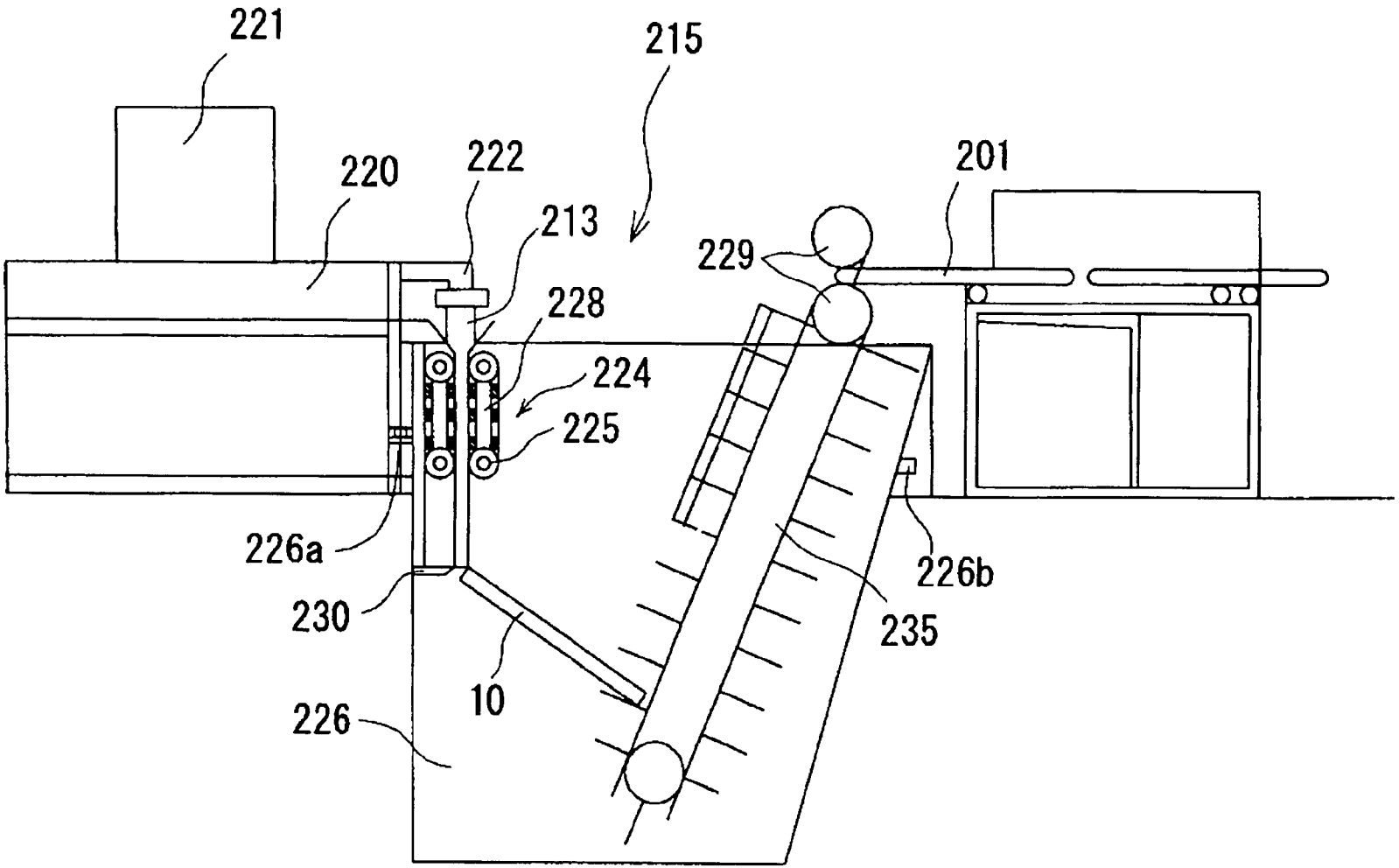
FIG. 11 shows an explanatory view illustrating another device for manufacturing a resin body with a spring structure.

A front view of FIG. 11 shows another exemplary system. This system further comprises a cutting unit 230 placed in a bath 226. The cutting unit 230 is put below and close to a winder 224. On a wall of the bath 226 opposite to the one to which the winder 224 is attached rests a conveying unit 235. The conveying unit 235 comprises a conveyor having multiple stopper spikes protruding from its surface. The stopper spikes are inserted into thin gaps between adjacent three-dimensional structure pieces obtained by cutting a three-dimensional structure sheet by means of the cutting unit 230. Constitutions of other parts are similar to corresponding members shown in FIGS. 9 and 10.

4-2. A Method for Manufacturing a Resin Body with a Spring Structure 10

Next, one example of a method for manufacturing a resin body with a spring structure 10 will be described.

Figure 12:
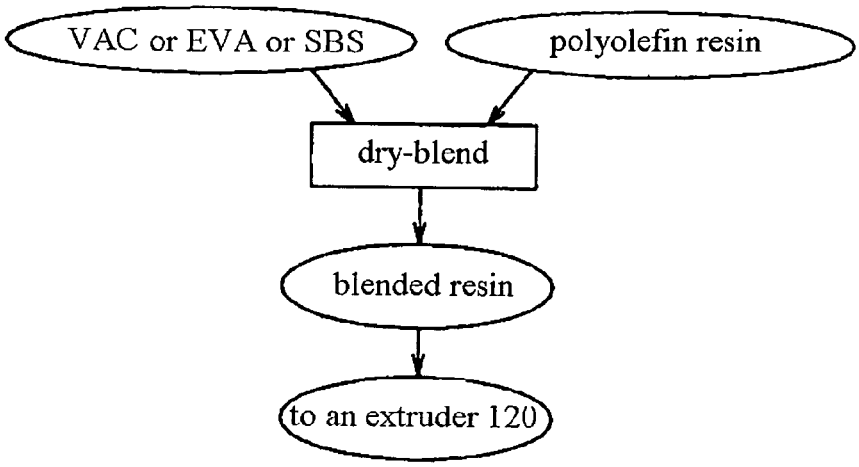
FIG. 12 shows a schematic view illustrating a manufacturing step for the resin body with a spring structure.
Figure 12:
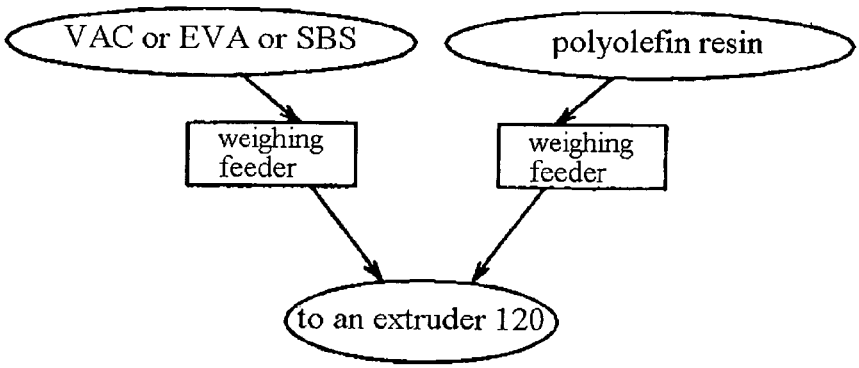
Figure 12:
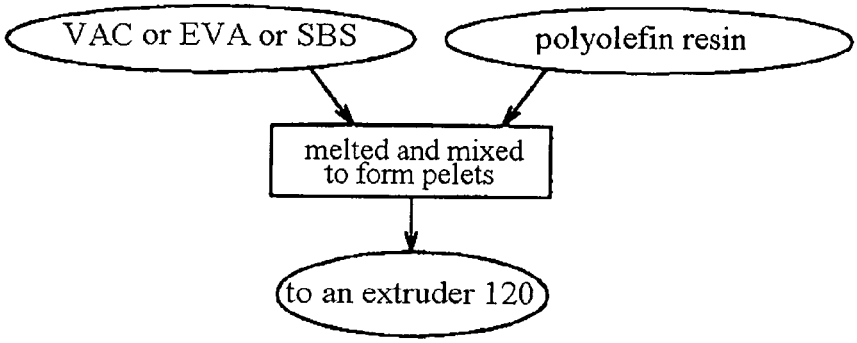

As shown in the diagrams of FIG. 12, according to the method of this embodiment for producing a resin body with a spring structure 10, preferably, a polyolefin resin such as PE, PP or the like and another resin such as VAC, EVA or SBS are fed, in appropriate amounts, via a supplier such as a tumbler or weighing feeder, and the yield is dry-blended, mixed, or dissolved in a solvent, kneaded and fragmented into pellets. The pellets are transferred to a hopper 121 of a compression molding system 120.

To be more specific, starting resins, e.g., PP and SBS are mixed with a tumbler (KR mixer, Kato Scientific Instruments Co.) at 40 rpm for 15 minutes.

Next, as seen from an explanatory view of FIG. 9, a mixture comprising the starting resins is applied via a hopper 121 to a uni-axial (axis diameter being 65 mm) compression molding system 120 (see FIG. 10). The mixture is melted at a predetermined temperature (200 to 260° C.), and the melt is kneaded and subjected to melt-extrusion at a predetermined speed through a plurality of nozzles on the extrusion surface of a molding die 122, taken off by a winder 124 which is described later, and formed into solid and/or hollow continuous filaments having a predetermined system (e.g., 600 to 90,000 deniers, preferably 3,000 to 30,000 deniers, more preferably 6,000 to 10,000 deniers). The filaments 12 in a melted state are passed through a loop-forming unit 150 as described above with reference to FIGS. 6-9 and FIG. 11, which causes adjacent filaments 12 to contact each other to be entwined into random loops having a diameter of 1 to 10 mm, preferably 1 to 5 mm. The contacted and entwined portions of filaments are at least partially fused and contacted to one another. Further, superficial layers 14, 15 having high bulk density and an inner layer 16 having low bulk density are formed. The filaments 12 may comprise solid filaments and hollow filaments at a predetermined ratio.

The thickness and bulk density of a three-dimensional structure or a mass of random loops may be determined as appropriate by adjusting the gap between the take-off rolls 125, 125 of winder 124 in a bath 126. The three-dimensional structure (e.g., 10 to 200 mm in width and 2,000 mm in length) obtained into a mass of random curls or loops, and hardening them in water, is passed through a pair of take-up rolls 129, 129 to produce a resin body with a spring structure 10.

When filaments 12 which have been formed into loops in water are taken off by the winder 24, the three-dimensional network property of the resulting three-dimensional structure may be altered as appropriate by adjusting the take-off speed of the winder 124. A bulk density of a resin body of a spring structure is 0.001 to 0.20 g/cm$^3$, preferably, 0.08 to 0.20 g/cm$^3$, and more preferably 0.10 to 0.18 g/cm$^3$, void ratio is 78 to 91%, preferably 80 to 88%. A bulk density of the superficial layers 14, 15 is 0.2 to 0.5 g/cm$^3$, preferably 0.3 to 0.4 g/cm$^3$, void ratio of the superficial layers is 44 to 77%, preferably 56 to 67%, a bulk density of the core layer 16 is 0.01 to 0.15 g/cm$^3$, preferably 0.03 to 0.05 g/cm$^3$, and void ratio of the core layer is 83 to 99% preferably, 94 to 97%.

In taking off the filaments, the take-off speed of the winder 124 is adjusted to a low take-off speed at intervals of by e.g., reducing the take-off speed of take-off rolls 125, 125 to a low predetermined level at certain predetermined regular intervals in synchrony with a timer. Then, it is possible to obtain a resin body with a spring structure 10 comprising a series of alternate high-density portions and low-density portions repeating at regular intervals (e.g., 30 to 50 cm) in a longitudinal direction, the high-density portions being formed when filaments are taken off at a low take-off speed while the low-density portions being formed when filaments are taken off at a high take-off speed.

As seen from a front view of FIG. 10, if it is expected that filaments constituting a resin body with a spring structure 10 comprising a three-dimensional structure will hardly be bent as needed when they are taken off by the take-off rolls 125, 125 at a normal constant speed, it is possible to adjust the take-off speed of the winder as above to produce a three-dimensional structure comprising a series of high-density portions and low-density portions, such that the three-dimensional structure can be bent at their low-density portions. The resin body with a spring structure 10 obtained via the above-described process is cut with a cutting unit 130 into pieces having a desired length.

The above-described process produces, for example, a resin body with a spring structure 10 having a bulk density of 0.03 g/cm$^3$ and thickness of 50 mm. The three-dimensional structure may be prepared from filaments made of one, or two or more kinds of resins.

4-3. Embodiment of a Device for Manufacturing a Resin Body 10 with a Spring Structure The extrusion system 120 used was a uni-axial extrusion system with a diameter of 90 mm. The starting material was an ethylene vinyl acetate copolymer. The processing conditions were as follows. The temperature of the resin was 250° C., the molding pressure 0.1 Mpa, the rotation of the screw 30 rpm, the extrusion force 135 kg/hr, and the take-off speed 32.3 m/hr.

Figure 13:
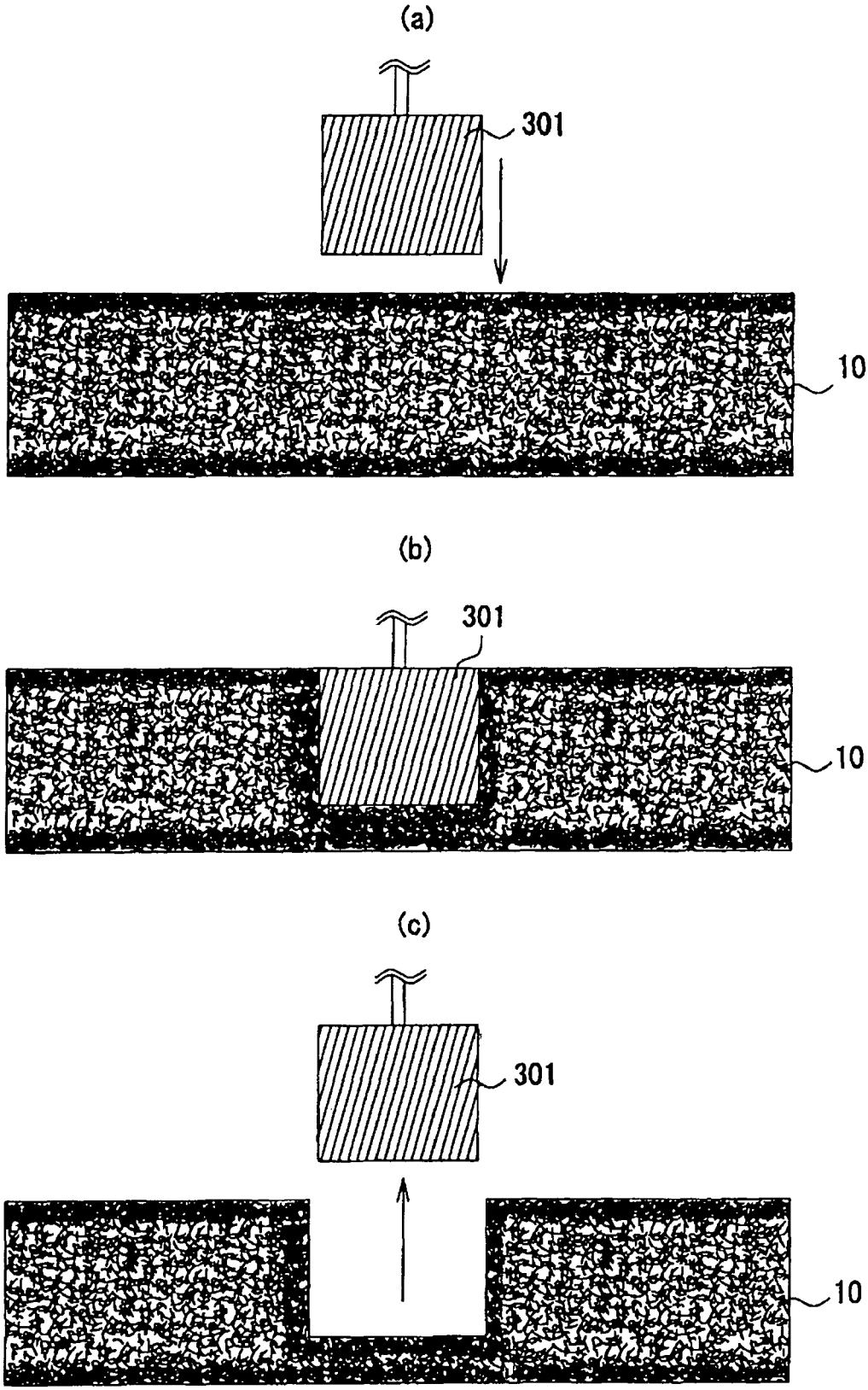
FIG. 13 shows a schematic view illustrating a method for forming a cavity of a resin body with a spring structure, and (*a*) to (*c*) illustrating states of each step.

A method for forming the cavity 23 will be described. The cavity 23 may be formed by mechanically cutting with a cutter or the like. However, since there is a possibility to generate noise, to prevent generation of the noise, as shown in FIG. 13, a cavity fusing a network body may be used by pushing the network body with heat press 301 (for example, 100° C.) from upper part.

What is claimed is:

1. A cushion comprising:

a resin body with a spring structure comprising a three-dimensional structure including voids at a predetermined bulk density, the three-dimensional structure being obtained by contacting, entwining, and gathering adjacent ones of random loops or curls of continuous filaments made from a thermoplastic resin in such a manner as to allow the resulting structure to have a layered structure in which layers composed of the filaments having high bulk density as superficial layers are formed on a front and rear of the resin body with the spring structure in a lengthwise direction and a layer composed of filaments having a low bulk density as a core layer is interposed between the superficial layers, wherein the resin body with the spring structure supports at least an upper half of a human body when using the cushion; and a speaker incorporated in the resin body with the spring structure or disposed on one of the superficial layers of the resin body with the spring structure, wherein each of the superficial layers has a bulk density of 0.2 to 0.5 g/cm$^3$ and a void ratio of 44 to 77%, and the core layer has a bulk density of 0.01 to 0.15 g/cm$^3$ and void ratio of 83 to 99%, a part of or all of the filaments composing the resin body with the spring structure are hollow, a diameter of the filaments composing the resin body with the spring structure is 0.3 to 3.0 mm when the filaments are solid, a diameter of the filaments constituting the resin body with a spring structure is 1.0 to 3.0 mm and a hollow ratio of the filament is 10 to 80% when the filaments are hollow, each of the filaments composing the resin body with the spring structure is functioned as a medium to conduct a wave to the human body, the wave for obtaining perception of sound or bodily sensation by vibration is conducted with each of the filaments composing the resin body with the spring structure as a media, and sonic wave without distortion is resonated on the superficial layers of the resin body with the spring structure.

2. The cushion according to claim 1, wherein a plurality of the speakers having different sound frequency to be output is disposed so that the sound frequency to be output is lowered from a head to a lower half of the human body.

3. The cushion according to claim 1, wherein the speakers are disposed within a range corresponding to an arrangement position of the human body when using the speakers.

4. The cushion according to claim 1, wherein the speaker is disposed on a rear of a belly of the human body to output a low-pitched tone as well as the speaker is disposed on a back of a chest of the human body to output a high-pitched tone according to the arrangement position of the human body when using the speakers.

5. A sonic system wherein the cushion according to claim 1 is disposed on a back supporting part of a human body supporting part comprising the back supporting part for supporting at least a back of the upper half of the human body.

* * * * *